US009371157B2

(12) United States Patent
Ou

(10) Patent No.: US 9,371,157 B2
(45) Date of Patent: Jun. 21, 2016

(54) TOOLBOX HANDLE

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

(21) Appl. No.: 14/534,552

(22) Filed: Nov. 6, 2014

(65) Prior Publication Data

US 2016/0130037 A1 May 12, 2016

(51) Int. Cl.

| | |
|---|---|
| ***B25H 3/00*** | (2006.01) |
| ***B65D 25/28*** | (2006.01) |
| ***B25H 3/02*** | (2006.01) |

(52) U.S. Cl.

CPC ..... *B65D 25/2802* (2013.01); *B25H 3/02* (2013.01); *B65D 2525/285* (2013.01)

(58) Field of Classification Search

CPC ..... B65D 25/2802; B65D 2525/285; B25H 3/02; Y10T 16/513; Y10T 16/515

USPC ..... 220/755; 294/158

See application file for complete search history.

(56) References Cited

U.S. PATENT DOCUMENTS

2003/0140458 A1* 7/2003 Lin ..... B25H 3/02 16/431

FOREIGN PATENT DOCUMENTS

| | | | | |
|---|---|---|---|---|
| DE | 3119464 | * | 12/1982 | ..... B65D 25/38 |
| TW | 569890 | U | 1/2004 | |
| TW | M447302 | U | 2/2013 | |
| TW | D152976 | S | 4/2013 | |
| TW | I435796 | B | 5/2014 | |

* cited by examiner

*Primary Examiner* — Fenn Mathew
*Assistant Examiner* — Elizabeth Volz
(74) *Attorney, Agent, or Firm* — Muncy, Geissler, Olds & Lowe, P.C.

(57) ABSTRACT

A toolbox handle is provided, including a connecting portion and a grip portion. The connecting portion is provided for being connected to a tool box. The grip portion is connected to the connecting portion, and the grip portion has a circumferential side for gripping. The circumferential side has at least one through hole. An inner circumferential face of each through hole is formed with at least one rib portion, and each through hole is at least partly stepped.

10 Claims, 5 Drawing Sheets

TOOLBOX HANDLE

BACKGROUND OF THE INVENTION

1. Field of the Invention

The present invention relates to a handle, and more particularly to a toolbox handle.

2. Description of the Prior Art

Conventionally, toolbox handles are made of hard materials to sustain heavy loads, and in order to increase the loading capacity, a radial dimension of the handle is enlarged or the handle has a solid structure. The toolbox handles disclosed in TWI435796, TWM447302 and TWD152976 have the above-mentioned structure. However, this kind of conventional arts focus on higher loading capacity and neglect user's feeling of gripping.

Therefore, TW569890 provides a suitcase handle in which an upper portion and a lower portion of the handle are made of two different materials. The upper portion of the handle is made of a harder material, and the lower portion of the handle is made of a softer material to improve the comfort of gripping. In addition, at least one through hole is disposed between the upper portion and the lower portion to increase air convection, keep the handle dry and prevent odors. However, in this kind of conventional arts, when the lower portion is made of the softer material, the loading capacity of the handle is reduced. The loading capacity is neglected for the pursuit of comfort. Besides, the through holes disposed between the upper and lower portions of the handle cause the upper portion to be too soft and deform easily, and the through holes will close completely to block air convection. After multiple times of use, the lower portion and the upper portion are prone to separate from each other.

The present invention is, therefore, arisen to obviate or at least mitigate the above-mentioned disadvantages.

SUMMARY OF THE INVENTION

The main object of the present invention is to provide a toolbox handle which gives a user a comfortable feeling of gripping and has preferable loading capacity and air convection.

To achieve the above and other objects, the toolbox handle of the present invention includes a connecting portion and a grip portion. The connecting portion is provided for being connected to a tool box. The grip portion and the connecting portion are mutually connected, and the grip portion has a circumferential side for gripping. The circumferential side is formed with at least one through hole. An inner circumferential face of each through hole is formed with at least one rib portion, and each through hole is at least partly stepped.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
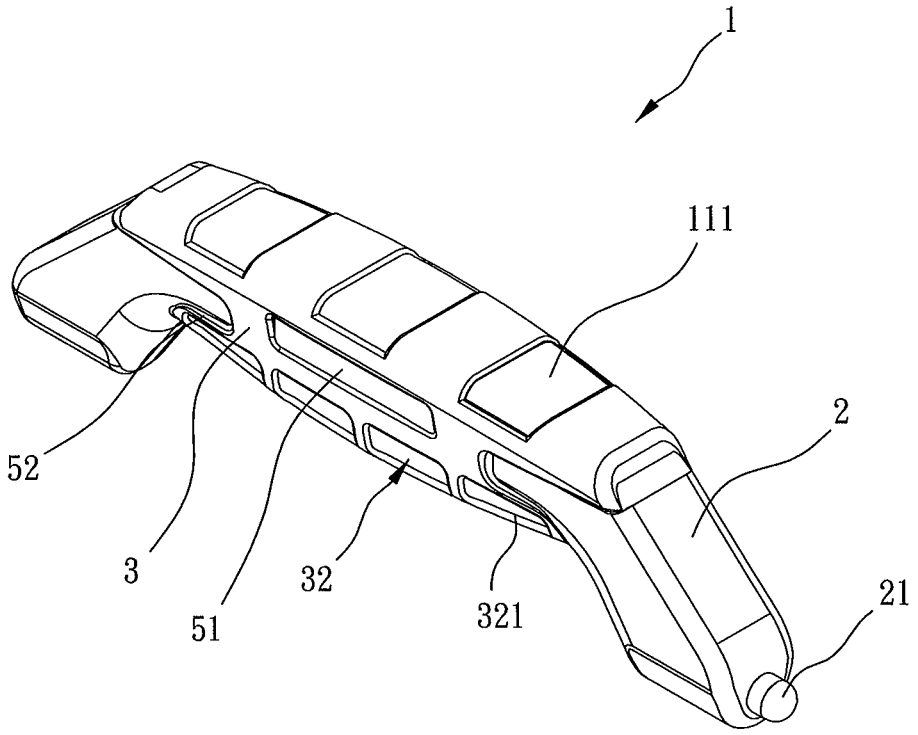
FIG. 1 is a sketch of a preferred embodiment of the present invention.

Please refer to FIGS. 1 to 5 for a preferred embodiment of a toolbox handle 1 of the present invention, including a connecting portion 2 and a grip portion 3.

The connecting portion 2 is provided for being connected to a tool box 6. In this embodiment, the connecting portion 2 can be disposed at two ends of the toolbox handle 1 respectively or disposed at only an end, but a number of the connecting portion 2 is not limited thereto. The grip portion 3 and the connecting portion 2 are mutually connected, and the grip portion 3 has a circumferential side 31 for gripping. The circumferential side 31 is formed with at least one through hole 32. An inner circumferential face 321 of each through hole 32 is formed with at least one rib portion 33, and each through hole 32 is at least partly stepped.

In addition, the circumferential side 31 partly covers the grip portion 3, and a disposing direction along which each through hole 32 runs through the grip portion is substantially perpendicular to an extension direction of the grip portion 3. Each through hole 32 is deformable; therefore, when the grip portion 3 receives a force, each through hole 32 deforms to reduce vibration; and when the user grips the toolbox handle 1, s/he will not think the grip portion 3 is hard and uncomfortable to grip. Hence, the deformability of the grip portion 3 can be controlled through adjusting a number or a dimension of the at least one through hole 32 to provide the user with comfortable feeling of gripping and allow air to flow through each through hole 32 to keep the grip portion 3 dry. Preferably, in view along the disposing direction, the at least one through hole 32 is symmetrically disposed relative to a center of the grip portion 3 to share a force averagely and to prevent the force from concentrating on a place and each through hole 32 from partly deforming. In this embodiment, the grip portion 3 is averagely formed with four the through holes 32; however, the number or dimension of each through hole 32 are changeable in accordance with different applications.

The four through holes 32 allow the grip portion 3 to partly deform to provide the user with comfortable feeling of gripping, and each rib portion 33 prevents the four through holes 32 from overly deforming or closing and allows the toolbox handle 1 to have enough supporting capacity to sustain a weight of the tool box 6. Therefore, the toolbox handle 1 can provide the user with comfortable feeling of gripping and serve the function of weight loading. It is to be noted that each rib portion 33 and the inner circumferential face 321 can be constructed in a multi-tiered structure or may be constructed in any other structure in accordance with various requirements and/or materials.

Preferably, the grip portion 3 has an upper portion 11 and a lower portion 12 which is formed with the four through holes 32, and an outer surface of the upper portion 11 is formed with at least one recessed portion 111. Relative to the through holes 32, the at least one recessed portion 111 is at least partly disposed between every two of the through holes 32. In this embodiment, three the recessed portions 111 are disposed on the outer surface of the upper portion 11 equidistantly. When the user grips the toolbox handle 1, his/her palm partly slightly comes into the three recessed portions 111 to make the grip portion 3 contact with his/her palm tightly, increase the contact area of the grip portion 3 and his/her palm and improve the stability of gripping. When the user grips an object, his/her fingers sustain more loads and may feel hurt and uncomfortable easily; therefore, the four through holes 32 are arranged on the lower portion 12 to allow the lower portion 12 to deform and further to make the user's fingers feel more comfortable. Preferably, the lower portion 12 is greater than the upper portion 11 in curvature, and the curvatures of the lower portion 12 and upper portion 11 correspond to the radians of the user's palm and fingers respectively so as to make the user feel more comfortable when gripping the toolbox handle 1.

In addition, an engaging portion 21 is disposed on the connecting portion 2, and the engaging portion 21 is detachably assembled to the tool box 6. When the toolbox handle 1 is damaged, the user only needs to repair the toolbox handle 1 instead of the whole tool box 6. In this embodiment, the engaging portion 21 is cylindrical to allow the toolbox handle 1 to rotate relative to the tool box 6. Furthermore, a marking portion 51 for marking is arranged on the grip portion 3 to allow the user to find the object s/he needs quickly.

Figure 2:
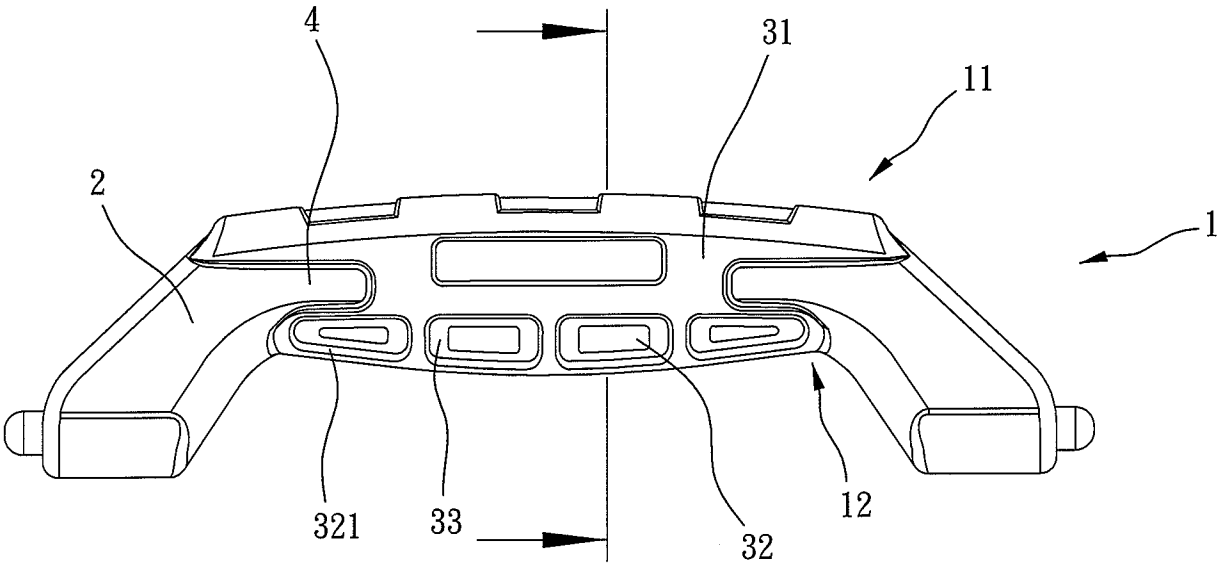
FIG. 2 is another sketch of a preferred embodiment of the present invention.
Figure 3:
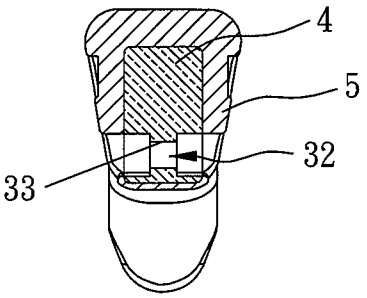
FIG. 3 is a cross-sectional view of a preferred embodiment of the present invention.
Figure 4:
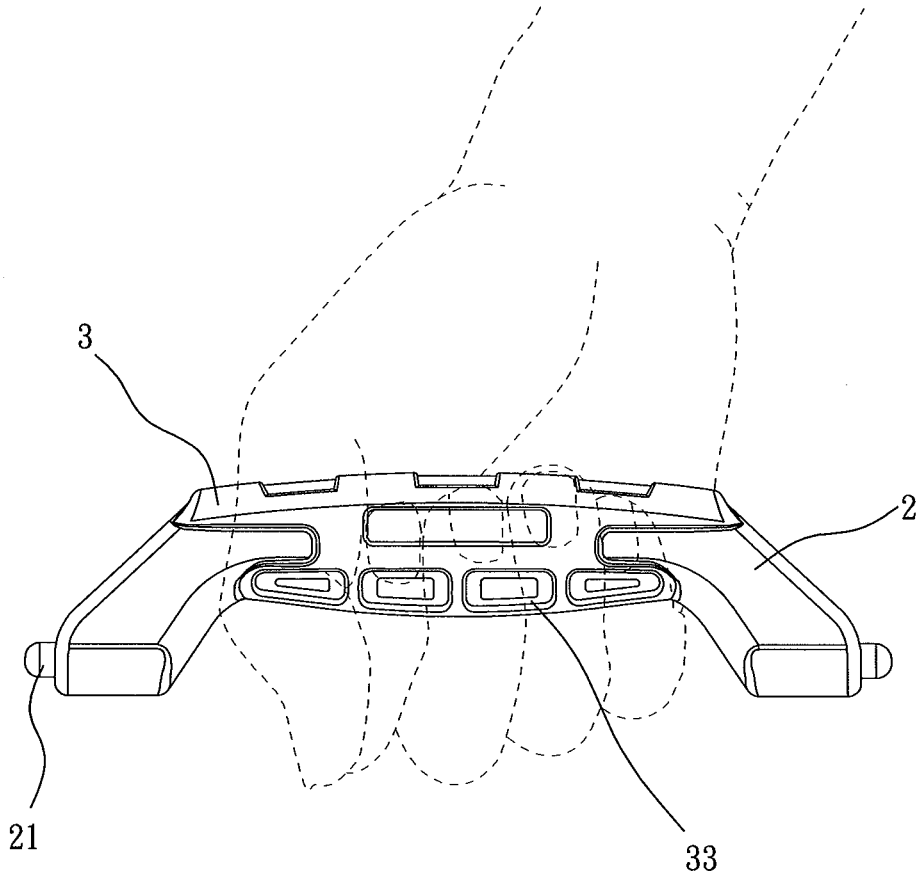
FIG. 4 is a drawing showing a preferred embodiment of the present invention in use.
Figure 5:
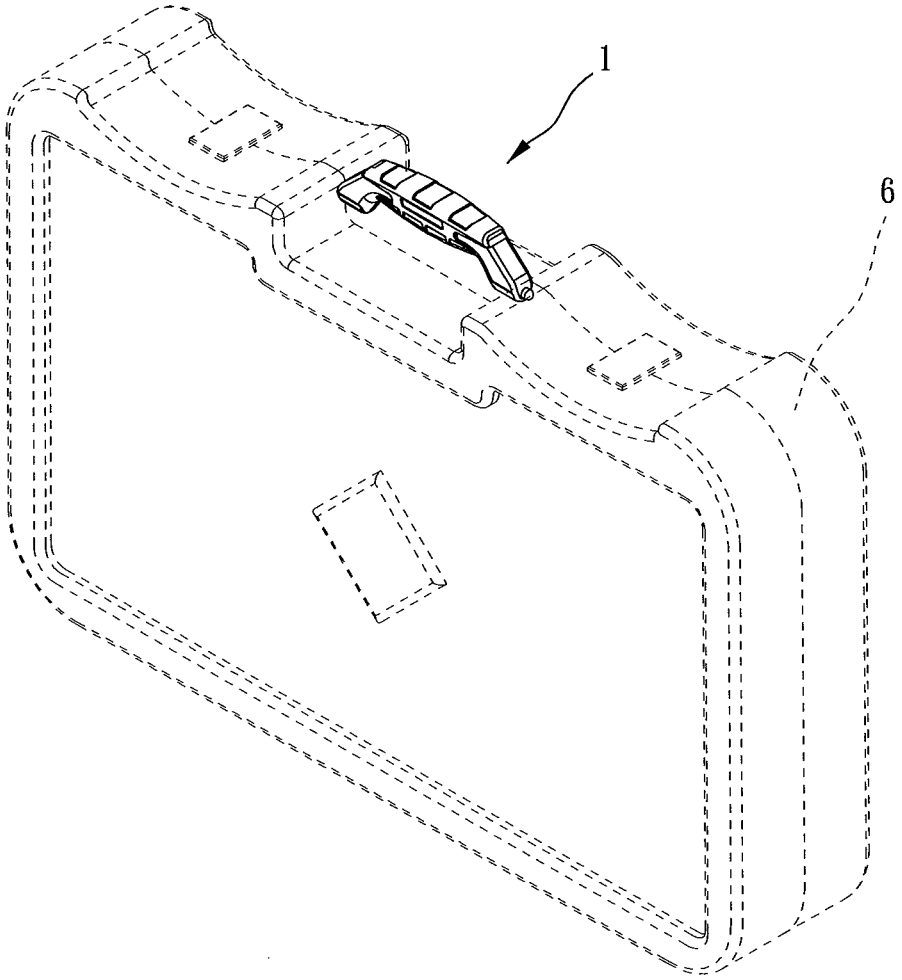
FIG. 5 is an assembling sketch of a preferred embodiment of the present invention.

Please refer to FIGS. 2 and 3. The grip portion 3 includes a main body 4 and a covering layer 5 disposed on an outer surface of the main body 4, and the main body 4 has the connecting portion 2 and each rib portion 33. The covering layer 5 and each rib portion 33 are at least partly stepped, which means that the four through holes 32 are disposed through the main body 4 and the covering layer 5. The covering layer 5 doesn't need to envelop the main body 4 completely, and preferably, a plurality of stepped abutting portions 52 is formed between the covering layer 5 and the main body 4. When the user grips the grip portion 3, the abutting portions 52 are provided for his/her fingers to abut thereagainst and for preventing his/her fingers from slipping. Preferably, the main body 4 is greater than the covering layer 5 in hardness. Specifically, in manufacturing the main body 4, a more solid material can be used to manufacture the part sustaining weight; and in order to provide the user with more comfortable feeling of gripping, the lower portion 12 can be formed with the four through holes 32, and the covering layer 5 can be made of softer materials. In other embodiments, each through hole 32 and each rib portion 33 can also be disposed on the covering layer 5 to make the user feel comfortable when gripping the toolbox handle 1.

Figure 6:
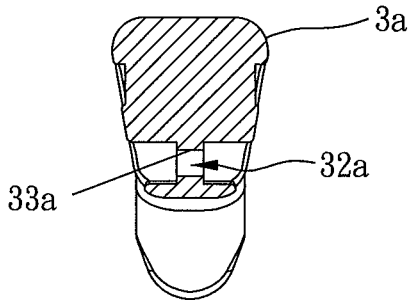
FIG. 6 is a cross-sectional view of another preferred embodiment of the present invention.
Figure 7:
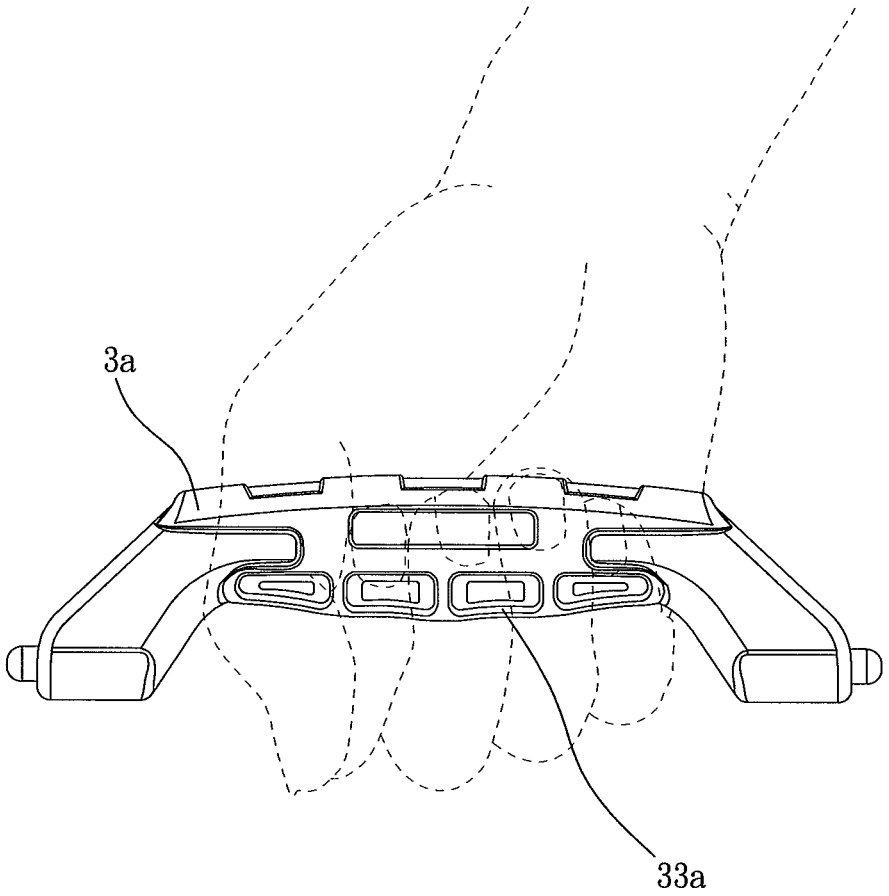
FIG. 7 is a drawing showing another preferred embodiment of the present invention in use.

Please refer to FIGS. 6 and 7 for a grip portion 3*a* of another preferred embodiment. The grip portion 3*a* includes at least one through hole 32*a* and at least one rib portion 33*a* disposed in each through hole 32, and the grip portion 3*a* is made of the same material so as to make it convenient and quick to produce and manufacture the grip portion 3*a*. When the material chosen is harder, an arrangement of each through hole 32*a* can be changed to improve the feeling of gripping; when the material chosen is softer, the rib portion 33*a* disposed in each through hole 32*a* provides extra effect of supporting and shaping; therefore, even if the grip portion 3*a* receives a heavier load, each through hole 32 can remain in the original shape and deform rather slightly.

Given the above, on the premise that the toolbox handle of the present invention aims to carry heavy objects, a plurality of through holes are disposed on the grip portion to allow the grip portion to deform, provide the user with comfortable feeling of gripping and keep the grip portion dry. In addition, the inner circumferential face of each through hole is formed with the rib portion to prevent the through hole from overly deforming; therefore, even if the toolbox handle is made of a softer material, each rib allows the toolbox handle to maintain the supporting capability to sustain the weight of the tool box. The toolbox handle of the present invention provides the user with preferable feeling of gripping and loading ability.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A toolbox handle, including:

a connecting portion, provided for being connected to a tool box; and a grip portion, being connected to the connecting portion, having a circumferential side for gripping, the circumferential side formed with at least one through hole, an inner circumferential face of each through hole formed with at least one rib portion, and each through hole being at least partly stepped, wherein the grip portion includes a main body and a covering layer disposed on an outer surface of the main body, the main body is greater than the covering layer in hardness, the main body has the connecting portion and each rib portion, the covering layer is coated on an outer face of a bottom of the main body which is located correspondingly under each through hole, the rib portion projects from the inner circumferential face of each through hole into each through hole, and corresponding to the inner circumferential face of each through hole the rib portion is inwardly protrusive relative to the covering layer, and the covering layer and the rib portion are steppedly arranged, and wherein each through hole is a laterally elongated hole which elongates in a direction toward the connecting portion.

2. The toolbox handle of claim 1, wherein each of the last one through hole penetrates the covering layer and the main body.

3. The toolbox handle of claim 1, wherein a plurality of stepped abutting portions are formed between the covering layer and the main body.

4. The toolbox handle of claim 1, wherein the connecting portion has an engaging portion, and the engaging portion is detachably assembled to the tool box.

5. The toolbox handle of claim 1, wherein a disposing direction along which each through hole runs through the grip portion is substantially perpendicular to an extending direction of the grip portion.

6. The toolbox handle of claim 1, wherein in view along the disposing direction, the at least one through hole is symmetrically disposed relative to a center of the grip portion.

7. The toolbox handle of claim 1, wherein the grip portion is formed with a marking portion for marking.

8. The toolbox handle of claim 1, wherein the covering layer is aligned with the main body around each through hole to form the inner circumferential face.

9. The toolbox handle of claim 1, wherein the grip portion has an upper portion and a lower portion which is formed with the at least one through hole which is a plurality of through holes, an outer surface of the upper portion has at least one recessed portion, and relative to each through hole the at least one recessed portion is at least partly disposed between every two of the through holes.

10. The toolbox handle of claim 9, wherein the lower portion is greater than the upper portion in curvature.

* * * * *